US008555523B2

(12) United States Patent
Dittmer et al.

(10) Patent No.: US 8,555,523 B2
(45) Date of Patent: Oct. 15, 2013

(54) CONDENSATION DRYER

(75) Inventors: Lothar Dittmer, Berlin (DE); Holger Löffler, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1388 days.

(21) Appl. No.: 11/886,399

(22) PCT Filed: Jan. 12, 2006

(86) PCT No.: PCT/EP2006/050182
§ 371 (c)(1),
(2), (4) Date: Sep. 13, 2007

(87) PCT Pub. No.: WO2006/097367
PCT Pub. Date: Sep. 21, 2006

(65) Prior Publication Data

US 2008/0104862 A1 May 8, 2008

(30) Foreign Application Priority Data

Mar. 18, 2005 (DE) ..... 10 2005 013 049

(51) Int. Cl.
*F26B 11/02* (2006.01)

(52) U.S. Cl.
USPC ..... 34/604; 34/603

(58) Field of Classification Search
USPC ..... 34/601, 595, 603, 604
See application file for complete search history.

(56) References Cited

U.S. PATENT DOCUMENTS

| | | | | |
|---|---|---|---|---|
| 5,317,816 | A | 6/1994 | Kadakia | |
| 2005/0072017 | A1 * | 4/2005 | Jo | 34/62 |
| 2005/0132594 | A1 * | 6/2005 | Doh et al. | 34/73 |

FOREIGN PATENT DOCUMENTS

| | | | | |
|---|---|---|---|---|
| DE | 31 35 292 | | 3/1983 | |
| DE | 85 35 335 | U | 5/1987 | |
| DE | 101 48 700 | | 5/2002 | |
| DE | 10148700 | A1 * | 5/2002 | D06F 58/24 |
| DE | 102 02 442 | | 8/2003 | |
| DE | 103 46 107 | | 6/2005 | |
| EP | 0 481 187 | | 4/1992 | |
| GB | 2 114 723 | | 8/1983 | |

OTHER PUBLICATIONS

International Search Report PCT/EP2006/050182.

* cited by examiner

*Primary Examiner* — Kenneth Rinehart
(74) *Attorney, Agent, or Firm* — James E. Howard; Andre Pallapies

(57) ABSTRACT

A method carried out without sealing elements inside fixed parts in the front area of a condensation dryer. A process air channel arranged in a shield is made of a plastic material and is provided with a vertical dividing surface which is placed at the level of a heat exchanger reception area in front of a base module. Said base module and the shield are assembled without additional sealing means. The tightness of the process air guide along the passage from the shield to a condenser is obtainable by supporting surfaces devoid of welds and hitches on the edges of the heat exchanger insertion opening, sealing elements placed on the circumference of a heat exchanger are pressed to each other when the dryer is prepared to operate.

15 Claims, 1 Drawing Sheet

CONDENSATION DRYER

Figure 1:
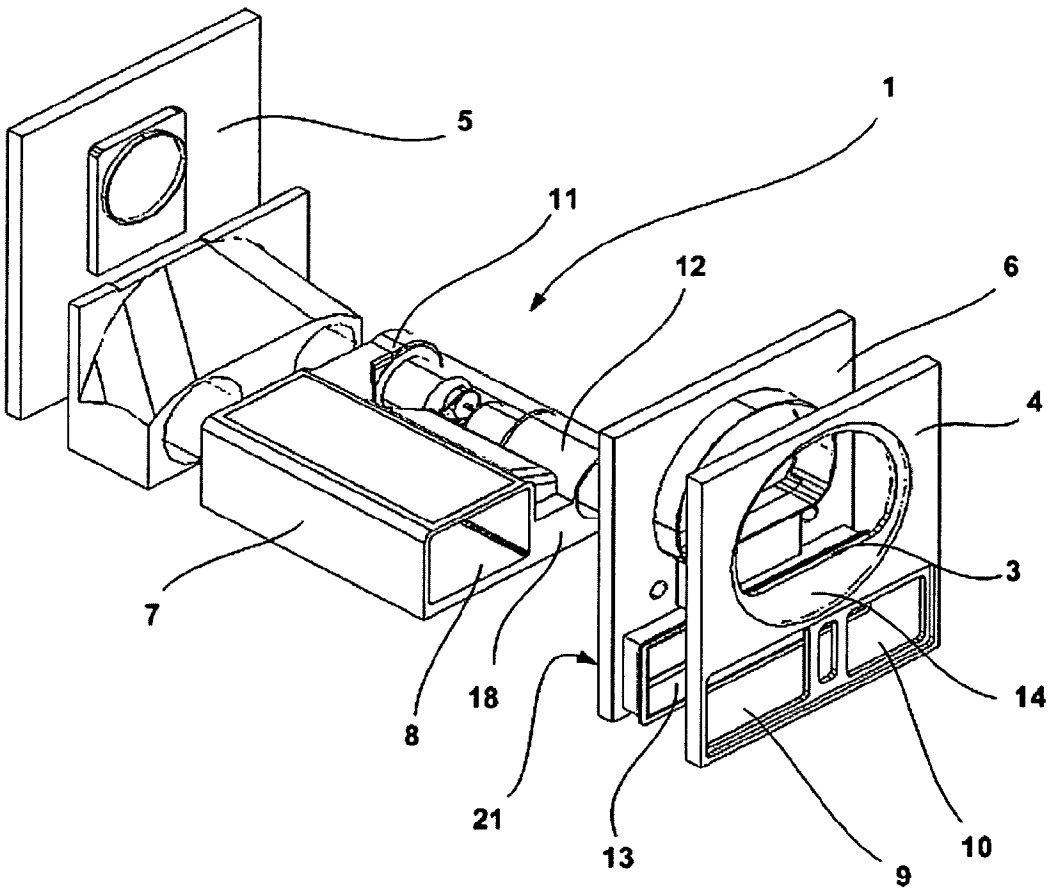

The invention relates to a condensation dryer with a drum able to be driven electrically and able to be rotated around at least one approximately horizontal axis for accommodating items to be dried, with a support plate for supporting the drum in the front area and for guiding the process air in this area, with a base module for functional parts for conveying and components for guiding the process air and the cooling air, with a heating device for the process air and with a housing for a slide-in heat exchanger able to be inserted from the front for condensing the moisture removed from the items to be dried.

Condensation dryers of the type discussed here are characterized by a flow of process air conveyed in a closed-circuit system. The process air heated up to a prespecifiable temperature is blown in during a drying process approximately axially through openings in the rear wall of the drum into the rotatable drum where the items to be dried are agitated and have the heated process air applied to them. The process air in such cases flows through the drum and absorbs moisture from the items to be dried. The process air is conveyed via a process air guidance channel in the front area downwards into a heat exchanger, cooled by cooling air sucked in from outside into the heat exchanger and during this process condenses the moisture removed from the items to be dried. The condensate is captured and discharged by means of a pump into a collection vessel. The heat exchanger is a separate slide-in unit which is accommodated in a cavity of a condenser in the base module. The base module also has mountings for the drive motor, for cooling air and process air blowers as well as a condensate capture tray and a condensate pump as well as devices for conveying and guiding the process air and the cooling air. The process air cooled and dehumidified in the condenser is directed via the heating device back into the inside of the drum. Items to be dried can be loaded into or unloaded from the drum via a frontal loading opening, which can be closed by a door hinged on the front panel.

A support plate which is joined to the machine housing to prevent rotation is used to support the drum on the front side. Such a support plate is described in DE 82 03 418 U1. The support plate manufactured as a plastic injection-molded part for sealed guidance is simultaneously embodied as the discharge process air channel via which the process air carrying the moisture from the laundry is directed downwards to the condenser. The exhaust channel has a flat rectangular cross section and widens out into a conical shape at the bottom. The bottom of the channel is open and provided with a flange which is encompassed by a press-fit sliding lid on its two long sides. The joint between exhaust channel and lid can be sealed by gluing or welding. At the transition point to the condenser a connecting support which is connected in a suitable manner to the process air channel in the condenser is provided for conveying the process air.

With other tumble driers on the market the support plate is made up of a number of parts which are joined together along horizontal and/or vertical jointing surfaces.

A condensation dryer described in DE 102 02 442 A1 is equipped with a slide-in condenser through which the process air is routed approximately in parallel to the axis of the drum. The condenser housing is a component of a base module. The process air is routed from the drum to the condenser via a front channel segment which is downstream from the process air outlet of the clothes drum and directs the air flow into the housing of the process air blower arranged on the front. The rectangular cross-section process air channel segment is connected at the top to the process air blowing housing. The jointing surface lies in a horizontal plane.

In the known condensation dryers the jointing surfaces of the individual components of the front-side process air channel as well as the connection to the process air channel in the floor area are hard to seal, so that energy losses and especially the escape of moisture to the outside cannot be avoided. The snap-on and clip connections used at these points cannot satisfy the high demands imposed with regard to sealing. To counter the danger of moisture escaping, additional sealing elements are therefore employed on the jointing surfaces of the modules, which disadvantageously not only increases the number of individual manufactured parts, but especially also the effort involved in assembling the devices.

The object of the invention, for a condensation dryer of the type stated at the start, is to specify improved routing of the process air in the front area of the device compared to the prior art. A further object of the invention is to make possible with the enhanced construction an overall more rational manufacturing of the individual parts and assembly of the tumble dryer.

The object is achieved, in accordance with the features described herein, by removing the need for the permanently-installed components for guiding the process air in the front area of the tumble dryer to have seals.

To this end the process air channel of the support plate is manufactured as a closely jointed plastic part comprising two sections. In at least one area adjoining the condenser the support plate features a vertical surface separating it from the base module. At this separating surface the two components base module and support plate are joined without additional sealing means. The process air is guided through the base module via the condenser. The sealing of the process air guidance at the transition between the support plate and the condenser is inventively established by seamless and smooth seating surfaces around the edges of the slide-in condenser opening, on which sealing means arranged around the circumference of the heat exchanger seat when the tumble dryer is ready to operate.

Compared to the known solution described above the inventive process air guidance enables a seal to be made which satisfies the highest requirements.

Further advantages emerge when the invention is used for the assembly of the dryer. Since the invention does not employ any sealing means for the support plate as process air guidance channel and for its connection to the heat exchanger holder in the base module, the number of the individual parts used overall is minimized, the effort involved in inventory control for such parts and that of assembly work in the final production of the devices is reduced.

Advantageous embodiments of the invention are contained in the subclaims and can be combined with each other in any manner without deviating from the invention.

The invention is explained in greater detail below based on an exemplary embodiment shown in the drawing. The associated drawing shows in FIG. 1 an exploded view of a condenser dryer with its modular components and FIG. 2 a perspective view of a heat exchanger removed from the condenser housing (holder 8).

Figure 2:
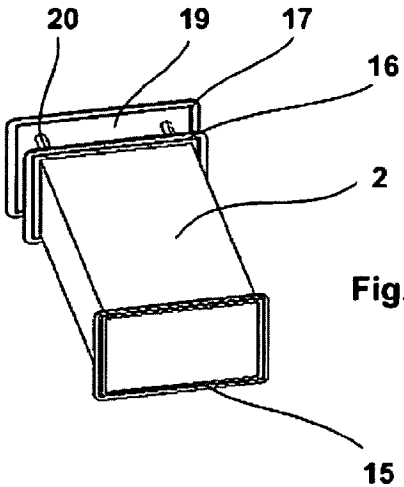

FIG. 1 shows major components of the tumble dryer 1 which are added as pre-assembled units in a final assembly process. The figure particularly shows the vertical arrangement of the separating surfaces of the unit as well as their relative size, which is not otherwise true-to-scale. To simplify the drawing the drum, which is arranged above the base module 7 between the support plate 6 and the rear panel 5, and parts of the housing are not shown.

The support plate 6 is embodied as a plastic injection-molded part and is permanently connected to the front panel 4. The support plate 6 in the preferred example extends down to the floor panel and across the full inner width of the housing of the tumble dryer 1 which is not shown in the drawing. The support plate 6 and the matching front-side outer housing panel (front panel 4) feature in the lower area an opening 9 for the heat exchanger 2 which can be inserted into the holder 8 in the base module 7 (FIG. 2) and a cooling air inlet opening 10. Located centrally above this is the loading opening 14, via which the laundry can be loaded into or unloaded from the drum not shown in drawing. The loading opening can be tightly sealed with a door likewise not shown in the diagram. The support plate 6 is shaped outwards below the loading opening 14 with a process air guidance channel 13. A lint filter 3 is arranged directly at the entry 14 of the process air channel 13 formed from the support plate accessible from the loading opening 14. The lint filter 3 is removable and easily accessible to the user when the door is opened to allow it to be cleaned.

The base module 7 is likewise an injection-molded compact plastic body into which the holders for the heat exchanger 2, the drive motor and the fans for the process air blower 111 and the cooling air blower 12 are formed. The separating surface 18 between base module 7 and support plate 6 lies in a vertical plane which extends across the full width of the tumble dryer 1. Base module 7 and support plate 6 are latched and screwed together.

The process air channel 13 running from top to bottom in the support plate is embodied so that the process air can be guided directly into the heat exchanger 2 inserted into the holder 8. The process air flows in the heat exchanger 2 through the base module 7 backwards from the support plate 6 where the heat exchanger 2 with its surrounding seal 15 seats on the smooth, seamless separating surface of an air guidance section, not shown in any greater detail, up to the rear panel 5. The transition from the front support plate to the base module 7 is also provided with an air-tight seal, on the one hand by a smooth and seamless pair of separating surface 18 on the base module 7 and seating surface 21 at the outlet opening of the support plate 6 and on the other hand by the sealing sleeve 16 attached to the heat exchanger inlet which is pressed against the separating surface 18 when the heat exchanger 2 is inserted and locked. The sealing sleeve 16 is supported against a collar formed around the circumference of the heater exchanger inlet.

The sealing of the process air channel 13 is established on the front side by a second smooth and seamless seating surface on the heat exchanger slide-in opening 9, against which the closure plate 19 rests with a sealing sleeve 17 attached to its circumference. The closure plate 19 for closing off the front-side slide-in heat exchanger opening 9 is preferably attached to the heat exchanger 2 by spacers 20 which promote the flow of air, the effect of which is, that with a locked heat exchanger 2, both openings present in the process air channel 13 for the slide-in condenser are simultaneously sealed.

In accordance with the invention all components permanently installed in the front area of the tumble dryer 1 for process air routing are joined at the interfaces without sealing elements. The sealing means used are exclusively attached to the heat exchanger 2 which, as s slide-in unit, is a separate manufactured part. This offers the further advantage of enabling the sealing means to be easily replaced if they are damaged as a result of ageing or incur damage because of mishandling.

REFERENCE SYMBOLS

1. Tumble dryer
2. Heat exchanger
3. Lint filter
4. Front wall
5. Rear wall
6. Support plate
7. Base module
8. Heat exchanger holder
9. Slide-in heat exchanger opening
10. Cooling air inlet opening
11. Process air blower
12. Cooling air blower
13. Process air channel
14. Loading opening
15. First sealing sleeve
16. Second sealing sleeve
17. Third sealing sleeve
18. Separating surface
19. Closure plate
20. Spacers
21. Seating surface

The invention claimed is:

1. A condensation dryer comprising: a drum for accommodating items to be dried and being rotatable about a substantially horizontal axis and being driven electrically; a support plate to support the drum in the front area and a process air channel for guiding the process air in this area; a base module comprising functional parts for conveyance and components for guiding the process air and the cooling air and also with a heating device for the process air and a holder for a heat exchanger able to be inserted from the front for condensing the moisture removed from the items to be dried; the base module in the area of the holder being joined at a seamless and smooth separating surface to a seamless and smooth first seating surface of the support plate without additional sealing means; and a first sealing sleeve attached to the circumference of the heat exchanger rests on the separating surface under pressure.

2. The tumble dryer as claimed in claim 1, wherein there is an opening for the slide-in heat exchanger in the support plate featuring a seamless and smooth second seating surface on its front and outlet side.

3. The tumble dryer as claimed in claim 2, wherein the heat exchanger features a closure plate on its front side for closing off the front-side slide-in unit opening which for guiding the process air is attached by means of spacers to the process air input side of the heat exchanger.

4. The tumble dryer as claimed in claim 3, further comprising a second sealing means attached to the inner side of the closure plate and running around the edge of said plate.

5. The tumble dryer as claimed in claim 3, wherein the spacers for the closure plate are shaped so as to promote air flow.

6. The tumble dryer as claimed in claim 1, wherein the support plate and the base module are plastic parts.

7. The tumble dryer as claimed in claim 1, wherein the separating surface and the seating surface lie at right angles to the direction of flow of the process air, at least in the area of the process air input side of the heat exchanger.

8. A condensation dryer comprising:

a drum to accommodate items to be dried and being rotatable about a substantially horizontal axis and being drivable electrically;

a support plate to support the drum in the front area, the support plate including an opening to guide process air;

a base module comprising at least one blower, a heating device to heat the process air, and a holder to hold a heat exchanger able to be inserted from the front to condense moisture removed from the items to be dried; and the base module in the area of the holder being sealingly joined to the support plate in a substantially air-tight manner solely by virtue of a joint formed by and between a seamless and smooth separating surface of the base module and a seamless and smooth first seating surface of the support plate such that full circumferential sealing around an outlet side of the opening of the support plate is achieved without additional sealing means.

9. The tumble dryer as claimed in claim 8, further comprising a seamless and smooth second seating surface adjacent an inlet side of the support plate.

10. The tumble dryer as claimed in claim 9, wherein the heat exchanger includes a closure plate on its front side to close off the opening which for guiding the process air is attached by means of spacers to a process air input side of the heat exchanger.

11. The tumble dryer as claimed in claim 10, further comprising a first seal attached to a circumference of the heat exchanger to rest on the separating surface under pressure, and a second seal attached to the inner side of the closure plate and running around the edge of said plate.

12. The tumble dryer as claimed in claim 10, wherein the spacers for the closure plate are shaped so as to promote air flow.

13. The tumble dryer as claimed in claim 8, wherein the support plate and the base module are plastic parts.

14. The tumble dryer as claimed in claim 8, wherein the separating surface and the first seating surface lie at right angles to the direction of flow of the process air, at least in the area of the process air input side of the heat exchanger.

15. The tumble dryer as claimed in claim 8, wherein the separating surface and the first seating surface form a sealed butt joint.

* * * * *

UNITED STATES PATENT AND TRADEMARK OFFICE

CERTIFICATE OF CORRECTION

PATENT NO. : 8,555,523 B2
APPLICATION NO. : 11/886399
DATED : October 15, 2013
INVENTOR(S) : Dittmer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1378 days.

Signed and Sealed this
Fifteenth Day of September, 2015

Michelle K. Lee

Michelle K. Lee
*Director of the United States Patent and Trademark Office*